United States Patent [19]

Cobb

[11] 4,157,054

[45] Jun. 5, 1979

[54] HYPERVELOCITY ROCKET SYSTEM WITH VELOCITY AMPLIFIER

[75] Inventor: Bernie J. Cobb, Huntsville, Ala.

[73] Assignee: The United States of America as represented by the Secretary of the Army, Washington, D.C.

[21] Appl. No.: 887,589

[22] Filed: Mar. 17, 1978

[51] Int. Cl.[2] ..... F41F 1/00

[52] U.S. Cl. ..... 89/8; 89/1.7; 89/1.816

[58] Field of Search ..... 89/8, 1.8, 1.816, 1.7–1.706; 102/93

[56] References Cited

U.S. PATENT DOCUMENTS

| | | | |
|---|---|---|---|
| 4,012,987 | 3/1977 | Burkhalter | 89/1.816 X |
| 4,023,496 | 5/1977 | Fink | 89/1.818 X |
| 4,038,903 | 8/1977 | Wohford | 89/8 |
| 4,073,213 | 2/1978 | Stauff | 89/1.704 X |

FOREIGN PATENT DOCUMENTS

| | | | |
|---|---|---|---|
| 2416161 | 8/1976 | Fed. Rep. of Germany | 89/1.816 |

*Primary Examiner*—David H. Brown

*Attorney, Agent, or Firm*—Nathan Edelberg; Robert P. Gibson; James T. Deaton

[57] ABSTRACT

A hypervelocity rocket system with velocity amplifier including a launch tube with a projectile mounted therein by sabot means and a rocket motor with an energy absorber at one end and mounted in the launch tube for impacting the projectile and causing velocity amplification of the projectile through momentum transfer as it is propelled from the launch tube.

5 Claims, 1 Drawing Figure

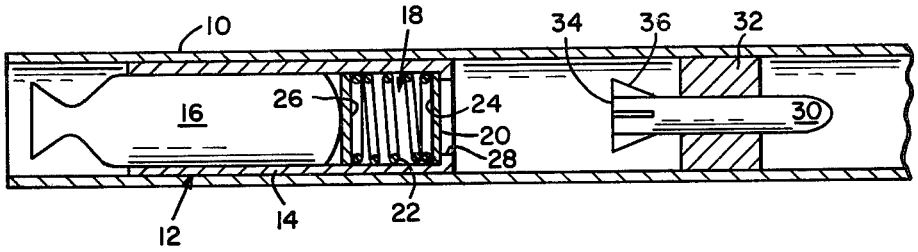
10
18
34
36
32
16
26
24
20
28
30
12
14
22

HYPERVELOCITY ROCKET SYSTEM WITH VELOCITY AMPLIFIER

DEDICATORY CLAUSE

The invention described herein may be manufactured, used, and licensed by or for the Government for governmental purposes without the payment to me of any royalties thereon.

BACKGROUND OF THE INVENTION

In the past, free rockets have been used in the light antitank application that have a chemical warhead or other type warhead that is propelled to its destination by a rocket motor to allow the warhead to perform its kill function. These devices are range limited for shoulder fired applications because the blast environment (rocket exhaust) limits the velocity.

Therefore, it is an object of this invention to provide a high velocity projectile accelerated to hypervelocity by a rocket that has an energy absorber therein that accomodates momentum transfer from the rocket to the projectile.

Another object of this invention is to provide a velocity amplifier in which velocity amplification is caused by a momentum transfer between two or more projectiles.

Other objects and advantages of this invention will be obvious to those skilled in this art.

SUMMARY OF THE INVENTION

In accordance with this invention, a rocket system with velocity amplification therein is provided which includes a conventional launch tube that can launch a rocket from a shoulder firing position and includes a first rocket that has an energy absorber in one end and an exhaust for the rocket motor at the other end. The rocket motor is of conventional structure for launching a projectile at high velocities. The launch tube also has a high velocity projectile mounted by sabot means in the launch tube and when the rocket motor is fired, the energy absorber is moved into contact with the high velocity projectile at which time a momentum transfer occurs and propels the projectile toward its target. That is, upon impact of the energy absorber with the high velocity projectile, some of the momentum is transferred to the projectile as impact energy is stored in the energy absorber. The rocket motor and projectile then move in the same direction at different velocities, the rocket motor is slowed down and the projectile is accelerated to hypervelocity.

BRIEF DESCRIPTION OF THE DRAWING

The single FIGURE of the drawing is a schematic sectional view of a rocket system with velocity amplification in accordance with this invention.

DESCRIPTION OF THE PREFERRED EMBODIMENT

Referring now to the drawing, a launch tube 10 illustrated partially cut away is of a conventional type that can be shoulder mounted for firing in a conventional manner. Launch tube 10 has a rocket 12 mounted therein that includes a housing 14 in which rocket motor 16 is mounted and which also houses energy absorbing means 18. Energy absorbing means 18 includes a plate 20 and spring 22 that is mounted between one surface 24 of plate 20 and a surface 26 within housing 14. Housing 14 also has an opening 28 through which streamlined projectile 30 has access to plate 20 and spring 22 of energy absorbing means 18. Projectile 30 is made of a solid material in a rod penetrating type form for penetrating a target by kinetics therein by being delivered at a hypervelocity. Projectile 30 is mounted in sabot means 32 in a conventional manner. Projectile 30 is positioned from energy absorbing means 18 of housing 14 to allow rocket 12 to attain a predetermined speed before contacting the projectile. Projectile 30 has fins 36 for stabilization thereof during flight.

In operation, rocket motor 16 is ignited in a conventional manner to propel rocket 12 toward projectile 30. Upon impact of end surface 34 with plate 20 of energy absorbing means 18, momentum is transferred from rocket 12 to projectile 30. Energy absorber 18 stores energy during the momentum transfer. Energy absorber means 18 can take a form other than a plate and spring as illustrated. For example, spring 18 could be other resilient means for storing energy therein (such as homogeneous or composite material).

To theoretically illustrate the velocity amplification in accordance with this invention by causing a momentum transfer between rocket 12 and projectile 30, the following is set forth. Rocket propulsion means 12 has a mass ($M_1$) and initial velocity ($V_1$) which changes to velocity $V_1'$) after impact. The projectile and sabot have an initial mass ($M_2$) and an initial velocity which is equal to zero but changes to velocity ($V_2$) after impact. From conservation of momentum:

$$M_1V_1=M_1V_1'+M_2V_2$$

Since an elastic impact is assumed because of the energy absorbing mechanism, the conservation of energy yields:

$$M_1V_1^2=M_1V_1'^2+M_1V_2^2$$

Combining these two relationships and solving for the projectile velocity ($V_2$), results in, $$V_2 = V_1[1 + (\frac{M_1 - M_2}{M_1 + M_2})]$$

this combined equation shows that the velocity can be amplified under these conditions, although it is limited by the relative masses.

This process can be improved by using three impacting bodies or more to cause a chain reaction. To illustrate the practicality of this invention, the following example is given.

Assume:

For the rocket 12 take-off weight is 3.60 pounds
propellant weight is 1.00 pounds
propellant specific impulse of 240 sec
burn-out weight is 2.60 pounds ($M_1$)
this gives a velocity of $V_1$=2515 fps For the projectile 30 and sabot sabot weight=0.10 pounds
projectile weight=0.50 pounds
therefore $M_2$=0.60 pounds From the combined equation above $$V_2 = V_1[1 + (\frac{M_1 - M_2}{M_1 + M_2})] = 2515[1 + (\frac{2.6 - .6}{2.6 + .6})]$$

$$V_2 = 4087 \text{ fps}$$

Overall system weight is:

| | |
|---|---|
| launcher | 3.50 pounds |
| rocket | 3.60 pounds |
| projectile and sabolt | .60 pounds |
| Total | 7.70 pounds |

From the above it can be clearly seen that a relatively light rocket system, provided with a launcher that propels the projectile at a hypervelocity, results from velocity amplification obtained through this means.

I claim:

1. A rocket system comprising: a launch tube, a projectile mounted by sabot means within said launch tube, and a rocket mounted in said launch tube and having energy absorber means at one end in spaced relation to said projectile, said energy absorber means causing velocity amplification to be imparted to said projectile by a momentum transfer between the rocket and the projectile when the rocket has been fired.

2. A rocket system as set forth in claim 1, wherein said energy absorber means includes a plate and resilient means for storing energy during momentum transfer to said projectile to cause the velocity amplification.

3. A rocket system as set forth in claim 2, wherein said resilient means includes a spring.

4. A rocket system as set forth in claim 3, wherein said projectile is made as a rod penetrator of solid material.

5. A rocket system as set forth in claim 4, wherein said projectile is streamlined in configuration and has fins.

* * * * *